US005787536A

United States Patent [19]

Pate

[11] Patent Number: 5,787,536

[45] Date of Patent: Aug. 4, 1998

[54] REMOTE SAW SYSTEM

[76] Inventor: Cecil Dwight Pate, 236 Iowa Colony Rd., Hollister, Mo. 65672

[21] Appl. No.: 496,534

[22] Filed: Jun. 29, 1995

[51] Int. Cl.[6] ..... B27B 17/00; B26B 27/00

[52] U.S. Cl. ..... 7/161; 30/296.1; 30/122; 7/158

[58] Field of Search ..... 30/296.1, 383, 30/382, 122; 7/158, 161

[56] References Cited

U.S. PATENT DOCUMENTS

| | | | |
|---|---|---|---|
| 3,731,380 | 5/1973 | Mathiesen . | |
| 3,731,382 | 5/1973 | Wroe . | |
| 3,886,658 | 6/1975 | Wikoff | 30/296.1 X |
| 3,949,440 | 4/1976 | Guerra | 7/161 X |
| 3,949,817 | 4/1976 | Rice . | |
| 4,207,675 | 6/1980 | Causey et al. . | |
| 4,269,241 | 5/1981 | Hickman | 30/122 X |
| 4,341,017 | 7/1982 | Janczak . | |
| 4,359,822 | 11/1982 | Kolodziejczyk . | |
| 4,435,902 | 3/1984 | Mercer et al. | 30/296.1 |
| 4,483,070 | 11/1984 | Junkermann | 30/296.1 |
| 4,566,188 | 1/1986 | Wilson | 30/122 X |
| 4,644,654 | 2/1987 | Howe et al. | 30/296.1 |
| 4,920,947 | 5/1990 | Scott et al. . | |
| 5,001,858 | 3/1991 | Frazar . | |
| 5,411,238 | 5/1995 | Caron . | |

*Primary Examiner*—D. S. Meislin
*Attorney, Agent, or Firm*—Senniger, Powers, Leavitt & Roedel

[57] ABSTRACT

The apparatus of the present invention is configured to cut a selected object at a location which is remote from a user. The apparatus comprises a saw having cutter teeth configured for cutting the selected object, a connector configured to attach to a mounting point generally above the location on the selected object, and a flexible line extending from the connector to the saw for positioning the saw adjacent the location on the selected object. The apparatus may also comprise a radio transmitter positioned within reach of the user, a servomechanism operatively connected to the saw for actuating the saw, and a radio receiver positioned remote from the radio transmitter for activating the servomechanism in response to the signal. Further, the apparatus may include a pole extending from the saw to guide the saw.

17 Claims, 6 Drawing Sheets

REMOTE SAW SYSTEM

BACKGROUND OF THE INVENTION (1) Field of the Invention

The present invention is directed to a saw which is remotely operable. In particular, the invention is directed to a saw system which may be operated from the ground to cut objects such as tree limbs that are located as much as forty feet or more above the ground.

(2) Description of the Related Art

One prior art method of pruning a tree limb is accomplished by climbing the tree and cutting the limb with a saw while in the tree. This limb removal method presents considerable risk of injury to the person performing the method. Not only does that person have a risk of falling out of the tree, but also the person stands the chance of cutting himself or herself due to the sometimes unstable position the person must assume while in the tree. This risk is further increased with the use of power saws such as electrically-powered or gasoline-powered chain saws because their increased cutting speed makes severe injuries more likely.

To overcome these risks, some persons use bucket trucks which include a gondola or bucket attached to a crane to prune trees. To use the bucket truck, the saw operator stands inside the bucket, moves the crane to position the bucket adjacent the selected location on the limb, and cuts the limb at the selected location. However, in densely-limbed trees, maneuvering the bucket to the position adjacent the selected location can be difficult and sometimes necessitates cutting additional branches to gain access to the selected location. Thus, this method may require additional time and effort because additional cuts must be made. Further, the additional cuts may be required on limbs which the person does not wish to cut because of the overall desired tree shape. Still further, bucket trucks are expensive to purchase or to rent thereby making this method cost prohibitive for many persons. In addition, because the user may be placed in the vicinity of overhead power lines, this method presents a risk of electrical shock to the user.

To overcome these previously described disadvantages, several prior art devices have been developed which comprise saws mounted on extensions so that the saws may be used to trim the limbs while the user remains on the ground. One such prior art saw and extension is described in U.S. Pat. No. 3,949,817 of Rice. This extension includes a short pole attached to a typical gasoline-powered chain saw. The pole includes a mechanical control cable extending from the chain saw accelerator to an auxiliary trigger mechanism attached to the pole remote from the chain saw. Thus configured, the user may raise the chain saw to a selected location somewhat remote from the user and accelerate the saw using the auxiliary trigger mechanism to cut the limb at the selected location.

A primary drawback of prior art chain saw extensions having the saw positioned remote from the user is that only relatively short extensions are practical because the weight of the chain saw is centered at a mechanically disadvantageous position. Thus, only limbs which are fairly close to the user may be trimmed using this type of extension because the extension must be relatively short to permit the saw to be lifted and used without undue user strain or fatigue.

Several prior art extension devices have overcome this problem by using lighter weight electrically-powered chain saws. Electrically-powered chain saws are connected to electrical cables which feed electricity to their motors to drive the cutter teeth. By controlling the flow of current through the electrical cables with a variable resistance controller, the speed of the saw may be regulated. Because the electrically-powered chain saws are typically lighter weight than gasoline-powered saws, longer extensions may be used without user strain or fatigue. However, even though chain saw extensions of this type may be longer than gasoline-powered chain saw extensions, they are still limited by the weight of the saw. Further, because an electrical cable must extend from the saw to the controller adjacent the user, an electrical connection is possible between the saw and the user. Thus, if a user inadvertently contacts the saw to a overhead power line, the user may receive a potentially lethal electrical shock. In addition, because electricity must be supplied to the saw motor in order for it to operate, a power source must be available in order to use the saw. However, power sources are not always convenient. Still further, electrically-powered chain saws tend to be less powerful than gasoline-powered chain saws. Therefore, the diameter of the limbs which may be cut with electrically-powered chain saws is generally smaller than the diameter of limbs which may be cut with gasoline-powered chain saws. Thus, the use of a electrically-powered chain saw limits the size of the tree limb which may be cut with the saw and extension system.

Other attempts to overcome the practical weight constraints include a device disclosed in U.S. Pat. No. 3,731,382 of Wroe. This chain saw extension includes a typical gasoline-powered chain saw motor driving a series of belts and pulleys extending through a tubular extension attached to the motor. The belts extend to a sprocket which drives a typical chain saw chain having cutter teeth which travel on a cutter bar mounted to the extension. Thus configured, the saw motor is positioned adjacent the user while the chain is used to cut limbs remote from the user. Because the relatively heavy motor portion of the chain saw is positioned near the user and may even be advantageously positioned behind the user to counter-balance the extension, longer extensions are practical than with the previously described prior art extensions which have the saw motor positioned adjacent the cutter teeth.

There are other prior art chain saw systems which use different power transmission apparatus in place of the belt and pulley system described above. For instance, a HUSQVARNA® chain saw sold under the designation, Model 250PS, uses a rotating flexible cable to transmit the power from the motor to the cutter bar. HUSQVARNA® is a U.S. federally registered trademark of Husqvarna Aktiebolag. The Model 250PS saw includes a gear box to convert the cable rotation to chain motion. Because the cable is relatively light weight, the overall weight of the chain saw extension is reduced to permit longer extensions. As a result, the HUSQVARNA® chain saw system advertises that limbs may be cut at distances up to twenty-three feet above the user's head.

Still another such system is described in U.S. Pat. No. 4,341,017 of Jancek. This system is similar to the HUSQVARNA® chain saw system except that the power is transmitted between the motor and cutter bar by hydraulic fluid driven through tubing extending from a hydraulic pump adjacent the engine to the cutter bar.

In order to further overcome the weight constraints associated with saws mounted on extensions, at least one prior art device uses the mechanical advantage of a fulcrum and lever to aid in lifting the saw and extension. Thus, longer extensions are practical. However, the fulcrum can make the system difficult to maneuver into position.

SUMMARY OF THE INVENTION

In order to overcome the problems associated with the prior art, the inventor of the present invention has developed a chain saw system which may be used to conveniently cut limbs located as high as forty feet or more above the ground without excessive strain or fatigue on the user. Further, the system of the present invention may be electrically insulated to lower the risk of shock. Still further, the system is easy to maneuver into position to relatively quickly, inexpensively and safely cut selected tree limbs.

The remote saw system of the present invention is generally comprised of a connector such as a hook which may be attached to the tree at a position generally above the selected location to be cut. The system may include a tackle having an upper block attached to the connector and a lower pulley which may be attached to a saw such as a chain saw to hoist the saw to the selected location. Prior to hoisting the saw into the tree, a guide pole may be attached to the saw to aid in maneuvering the saw. A radio receiver and servomechanism may be operatively connected to the saw to control the speed of the cutter teeth. The user may send a signal to the receiver with a radio transmitter positioned adjacent the user to accelerate the saw and cut the limb or other object.

BRIEF DESCRIPTION OF THE DRAWINGS

Further objects and features of the present invention are revealed in the following Detailed Description of the Preferred Embodiment of the invention and in the drawing figures wherein.

DETAILED DESCRIPTION OF THE PREFERRED EMBODIMENT

Figure 1:
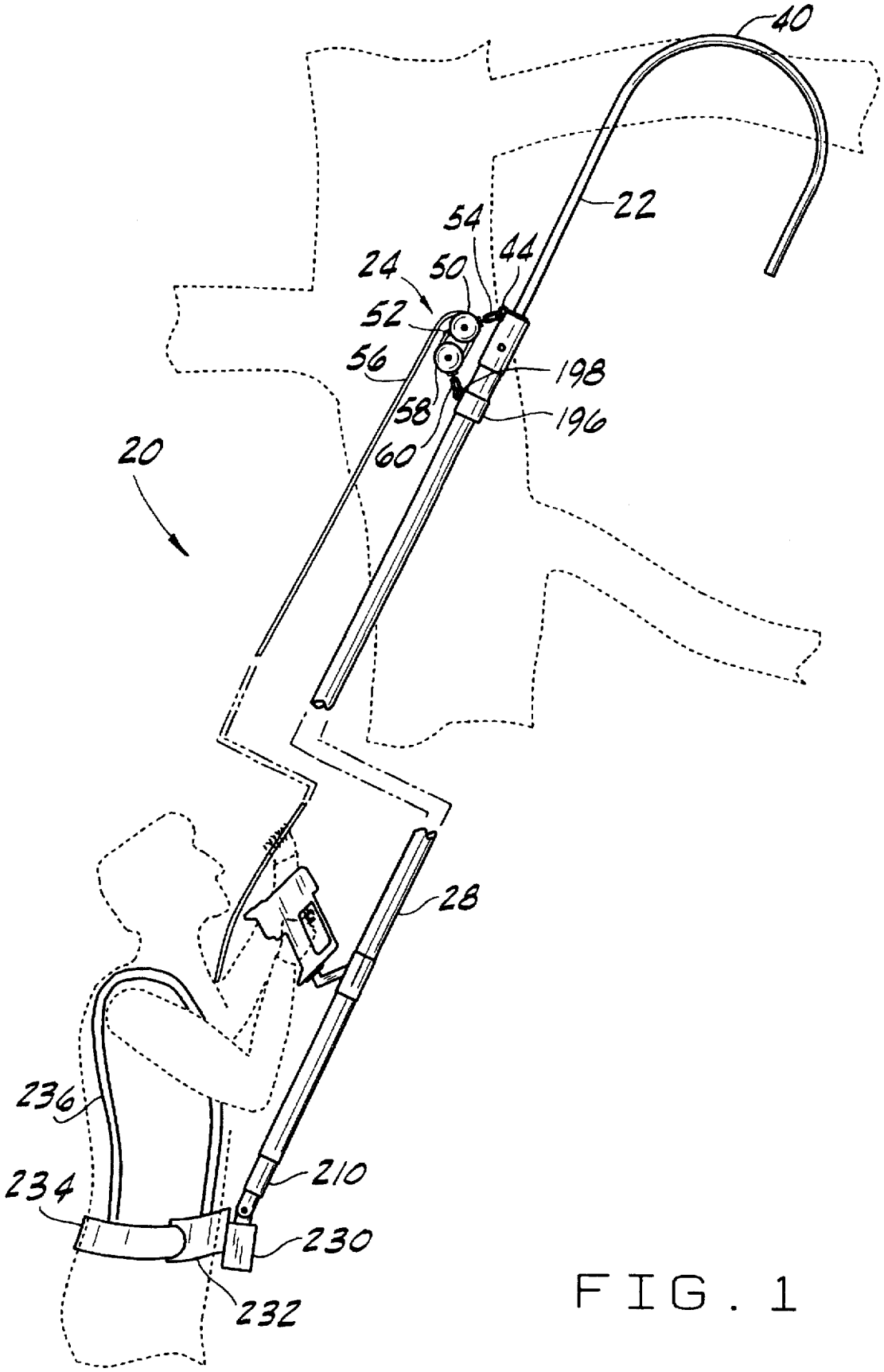
FIG. 1 is a side elevation view of the connector and guide pole assembly being installed in a tree above a selected limb to be cut.
Figure 2:
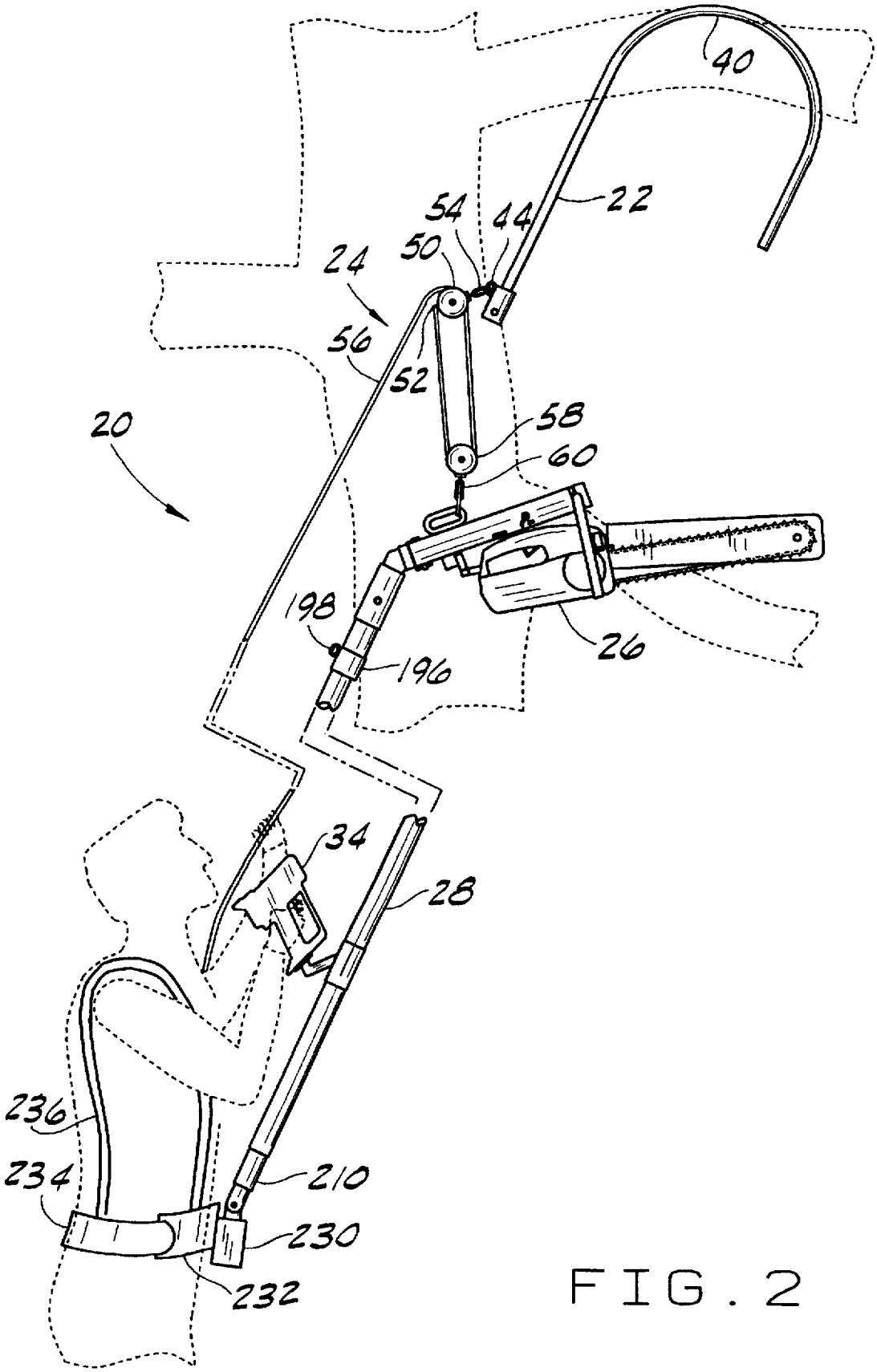
FIG. 2 is a side elevation view of the connector, chain saw and guide pole assembly being used to cut the selected limb.
Figure 3:
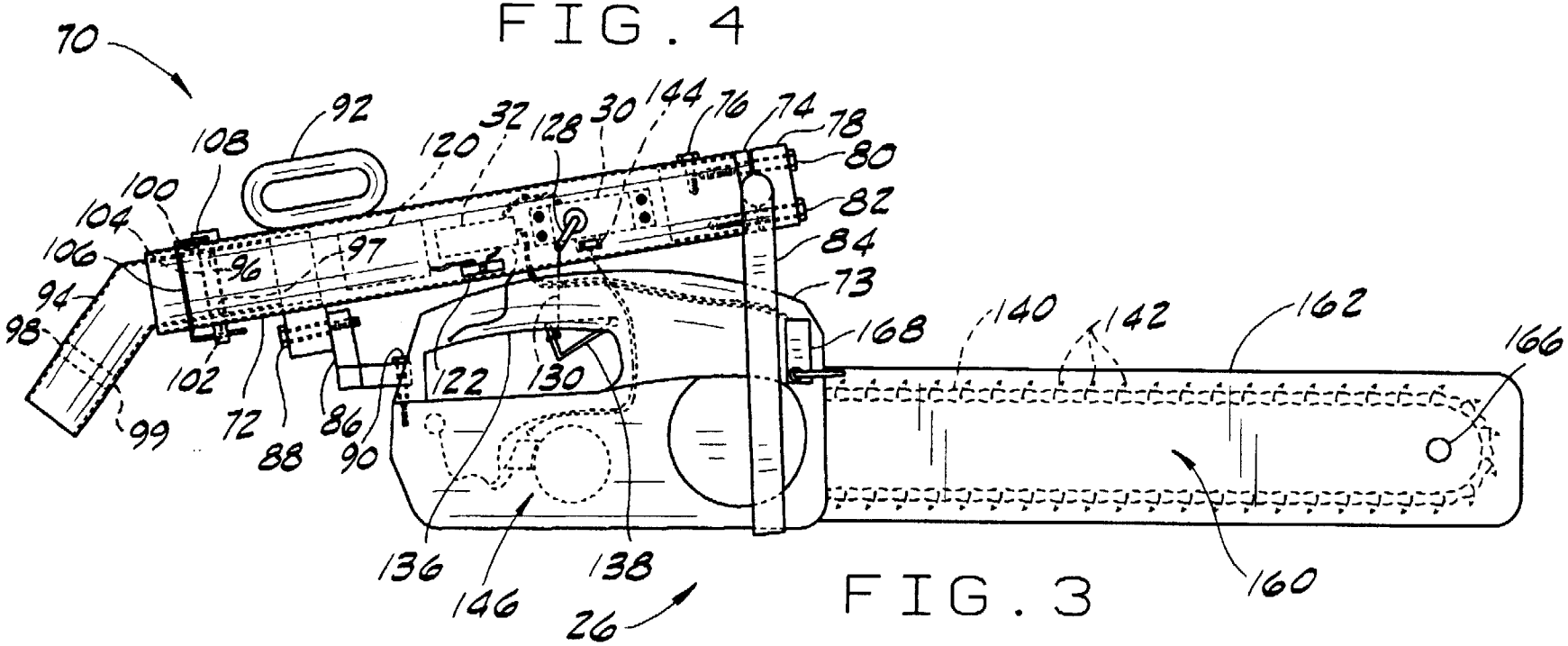
FIG. 3 is a side elevation of a chain saw and a mounting attachment,for securing the saw to the guide pole.

As shown in FIGS. 1, 2 and 3, the remote saw system 20 of the present invention is generally comprised of a connector 22, a tackle 24, a chain saw 26, and a guide pole 28. The speed of the chain saw 26 is controlled by a servomechanism 30 connected to a radio receiver 32 which is controlled by a radio transmitter 34 positioned remote from the chain saw.

Figure 5:
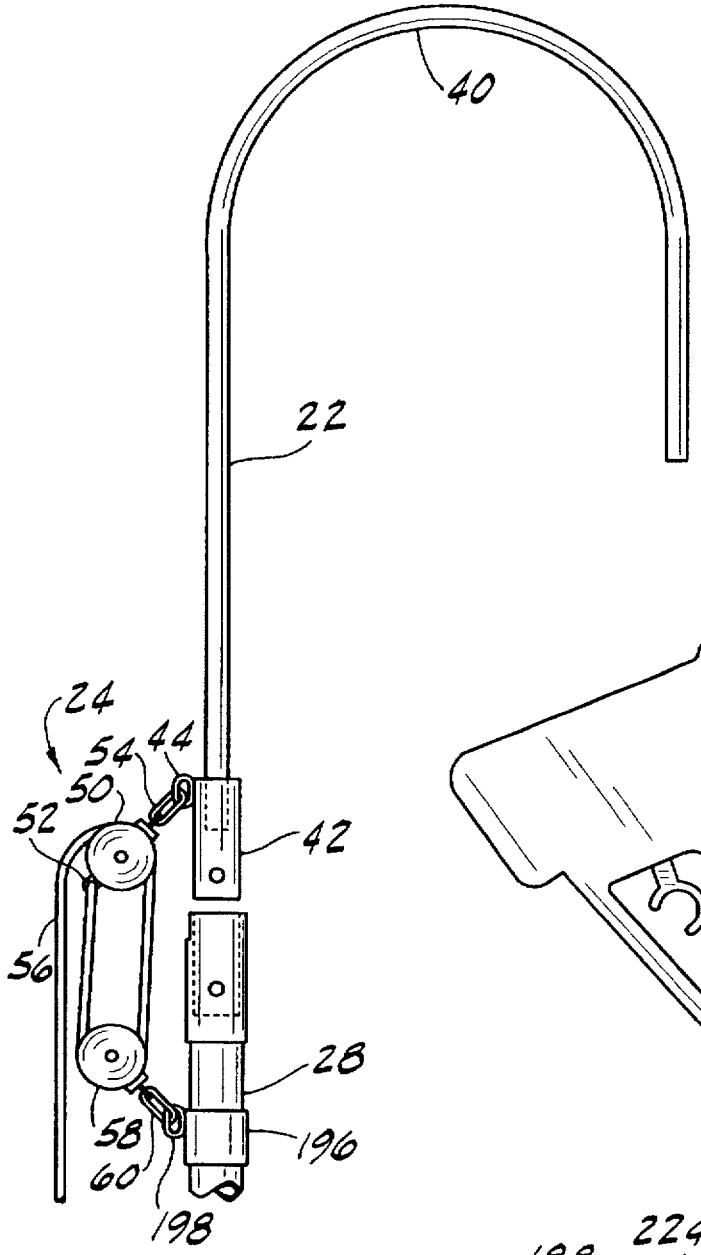
FIG. 5 is a partial side elevation view of the connector and tackle prior to assembly on the upper end of the upper guide pole.

Referring to FIG. 5, the connector 22 of the preferred embodiment is fashioned as a hook 40 having a fitting 42 at one end configured for attachment to the guide pole 28. The fitting has an eye 44 for connecting the tackle 24 to the hook 40. As will be explained in greater detail below, the tackle 24 is used to hoist the chain saw 26 to a cutting position as shown in FIG. 2.

The tackle 24 is comprised of an upper block 50 having a becket 52. The upper block 50 is connected to the eye 44 with a shackle 54 or other link. A line 56 such as braided rope or cable is connected to the becket 52. The line 56 extends generally downward from the upper block becket to a lower pulley 58 where the line turns and returns to the upper block 50 before turning downward and extending toward the user. The lower pulley 58 is connected to a carabiner 60 or other quick-disconnect-type fastener. Thus configured, the tackle 24 offers a 2:1 purchase when hoisting objects attached to the lower pulley 58 by the carabiner 60. Nonetheless, other mechanical advantage ratios are also within the scope of this invention. As will be explained below, the upper block 50 may also include a line brake mechanism for inhibiting the hoisted object from falling to the ground when a user inadvertently releases the line 56.

The chain saw 26 of the preferred embodiment is a stock saw which has been modified for radio control and attachment to the guide pole 28. A mounting attachment 70 which is best seen in FIG. 3 is fastened to the stock chain saw. The mounting attachment 70 is comprised of a hollow pipe 72 mounted to the chain saw generally above the chain saw housing 73. An end cap 74 which is held in place by a fastener 76 is attached to the forward end of the pipe 72 and a clamping plate 78 is attached to the end cap 74 with two bolts 80, 82. The mating surfaces of the end cap 74 and clamping plate 78 are slotted to accommodate a standard front hand grip 84 of the chain saw. An appropriately shaped bracket 86 extends between the back of the chain saw and the mounting attachment 70 to rigidly connect the mounting attachment to the chain saw. Fasteners 88, 90 are used to connect the bracket to both the rearward end of the chain saw housing 73 and the mounting attachment 70 in the preferred embodiment. Depending upon the make and model of chain saw used, the shape of the bracket and quantity and size of the fasteners may be changed to accommodate different chain saws. Extending from the top of the mounting attachment 70 is a hoisting eye 92 which is used to connect the mounting attachment to the tackle 24. An elbow 94 which is configured to be attached to the guide pole 28 is connected to the rearward end of the mounting attachment 70. Although other angles are within the intended scope of this invention, the elbow of the preferred embodiment includes an angle of between 120 and 145 degrees. Holes 96, 97, 98, 99 extend diametrically through the elbow at either end, and holes 100, 102 positioned in the mounting attachment 70 are positioned so that holes 96, 97 align with them when the elbow 94 is seated within the mounting attachment. A pin 104 having a C-shaped keeper 106 attached to its head 108 is inserted through the aligned holes 96, 97, 100, 102 to fasten the elbow 94 to the mounting attachment 70. The C-shaped keeper 106 partially circumscribes the mounting attachment 70 and engages the end of the pin 104 opposite the head 108 to retain the pin in place and prevent accidental separation of the elbow 94 from the mounting attachment 70.

A battery pack 120 is mounted within the hollow interior of the mounting attachment 70 for powering the radio receiver 32. An on-off switch 122 is connected in circuit between the battery pack 120 and radio receiver 32 for disconnecting the battery when the receiver is not in use to conserve the electrical charge stored in the pack. The radio receiver 32 is a standard receiver commonly used to control radio controlled models. The receiver 32 outputs an electrical control current in response to a radio signal received from the remote transmitter 34. Not only does the receiver 32 detect the presence of a radio signal from the transmitter 34, but also it detects changes in the signature of the received radio signal. For instance, the receiver 32 may be capable of detecting changes in signal frequency or amplitude and will change the electrical control current accordingly. The electrical control current output from the receiver 32 is fed into the servomechanism 30 which converts the electrical control current into either a rotational or translational motion depending upon the servomechanism configuration. In the case of the preferred embodiment, the servomechanism 30 includes an arm 128 which rotates in response to the electrical control current. A thin control rod 130 is attached to the arm 128. This control rod 130 extends downward through an opening in the mounting attachment 70, through a second opening in the handle 136 of the chain saw, and is connected to the throttle trigger 138. Thus configured, the control rod 130 pulls on the throttle trigger 138 as the servomechanism arm 128 rotates to accelerate or decelerate the chain saw chain 140 and cutter teeth 142 just as when an operator manually actuates the trigger on the chain saw. The radio receiver 32 may also be configured to send an electrical signal to a microswitch 144 which is connected in series with the chain saw ignition system 146 so that the chain saw engine will die when a predetermined radio signal signature is detected by the receiver 122.

As with any conventional stock chain saw, the chain 140 and cutter teeth 142 travel along an elongate guide bar 160. A chain guard 162 is pivotally mounted to the guide bar 160 in the preferred embodiment. The chain guard 162 is comprised of two plates, one of which is mounted adjacent each side of the guide bar 160. The plates are sized to extend past the edges of the chain 140 and cutter teeth 142 to prevent contact with the cutter teeth when the guard 162 is in the position shown in FIG. 3. The guard 162 is mounted pivotally to the chain saw guide bar 160 with a pivot pin 166 to permit the guard to rotate either upward or downward to expose the cutter teeth 142 and permit a cut to be made.

A second servomechanism 168 may be operatively connected to the chain guard 162 to hold it in a locked position with the cutter teeth 142 covered. The second servomechanism 168 may be controlled similarly to the first servomechanism 32 by an electrical control current output from the receiver 30. Thus, in the preferred embodiment, the receiver 30 is a multi-channel receiver, the first channel controlling the first servomechanism 32 and the second channel controlling the second servomechanism 168.

Figure 4:
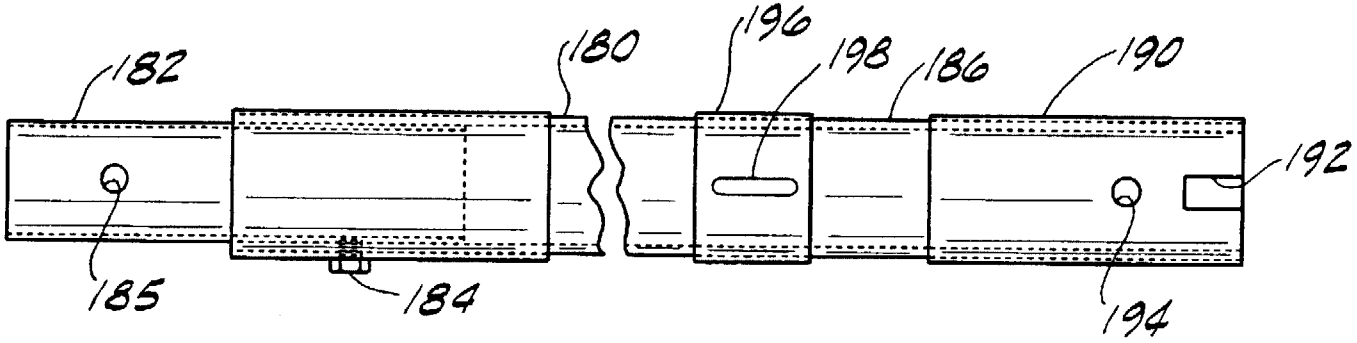
FIG. 4 is a partial top plan view of an upper and intermediate guide pole.

The guide pole 28 (see FIGS. 4 and 7) is comprised of eight-foot lengths of non-electrically conducting tubing 180 connected by couplers 182 and pins 183 substantially as described above with respect to the elbow 94 and mounting attachment 70. In the best mode, the eight-foot lengths of tubing 180 are fashioned from fiberglass firefighter's pike poles which are reinforced at their ends with metal bands. Couplers 182 are attached to one end of each pole with a fastener 184, and holes 185 are provided in each coupler 182 to accept the pins 183. Alternately, the couplers may be attached to the pole with adhesive. Thus, when the lengths of tubing are disassembled, the couplers 182 are conveniently retained with the lengths of tubing.

The upper most piece of tubing 186 (see FIG. 4) and the lower most piece of tubing 188 (see FIG. 7) have different configurations from the remaining intermediate lengths of tubing 180 between the upper and lower pieces. The upper tubing 186 includes an end fitting 190 having an axial notch 192 at one circumferential location. When the connector 22 on the mounting attachment 70 is coupled to the guide pole 28, the eye 44 of the connector seats within the notch 192 to prevent rotational movement of the connector relative to the guide pole. The end fitting 190 also includes a hole 194 extending diametrically through the fitting for accepting a pin to connect the guide pole 28 to the elbow 94 similarly to the connection between the elbow 94 and mounting attachment 70. Spaced from the upper end of the upper tubing 186 is a fitting 196 having an eye 198 axially aligned with the notch 192. This eye 198 is used to fasten the carabiner 60 attached to the tackle 24 thereby temporarily holding the connector 22 and guide pole 28 together when installing the hook and tackle in the tree. At the lower end of the upper tubing 186 is a coupler 182 which is attached to the tubing with a fastener.

Figure 6:
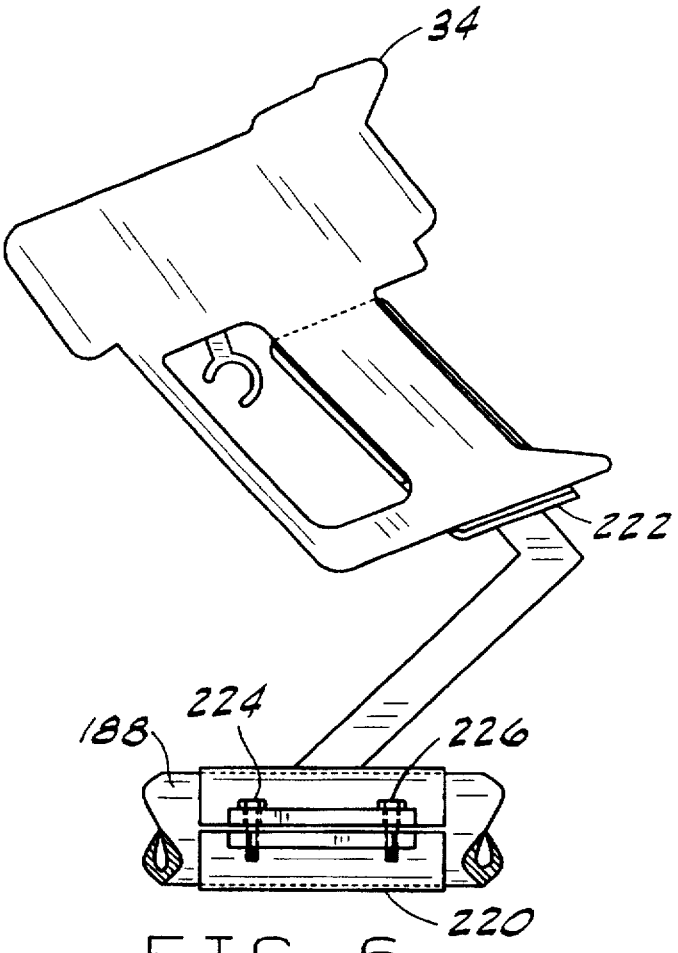
FIG. 6 is partial side elevation view of the radio transmitter used to control the chain saw.

The lower tubing 188 (see FIGS. 6 and 7) has some unique features relative to the other tubings 180, 186. Attached to the lower end of the lower tubing 188 is a coupler 210 which is similar to the coupler 182 on the upper and intermediate tubings 180, 186 except that a hinged end cap 212 is pivotally connected to the coupler 210 with a bolt 214. The hinged end cap 212 includes a distal plug 216 which articulates about a wrist pin 218 so that the plug swivels freely with respect to the lower tubing. A clamp 220 which holds a gun bracket 222 on the lower tubing 188 with a fastener 224 is positioned on the lower tubing above the hinged end cap 212. The gun bracket 222 is configured to accept a stock radio transmitter 34 such as a FUTABA® MAGNUM SPORT FP-2PB® digital proportional radio control transmitter and locate the transmitter at a convenient position for actuation by the user. FUTABA® and MAGNUM SPORT FP-2PB® are U.S. federally registered trademarks of Futaba Denshi Kogyo Kabushiki Kaisha of Mobara-Shi Chiba-Ken, Japan. The gun bracket 222 may also include a fastener 226 to permit the transmitter 34 to be removed for service.

Figure 7:
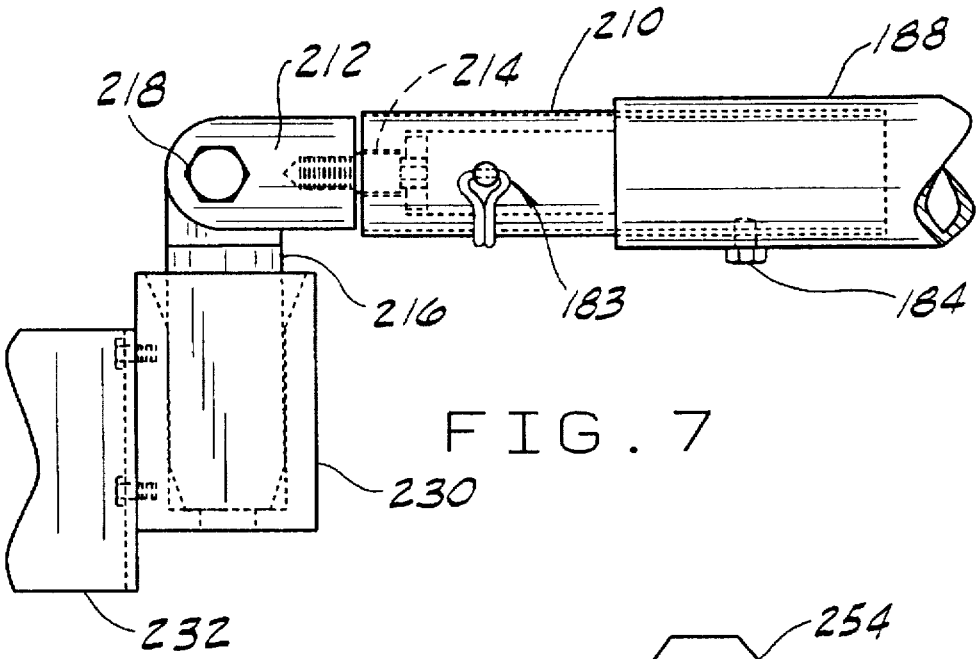
FIG. 7 is a partial side elevation view of the lower end of the lower guide pole and a support belt.

As best seen in FIGS. 1,2 and 7, the lower tubing end cap plug 216 sits within a bushing 230 mounted to a curved plate 232 which is held in position on the user by a belt 234 and suspenders 236. Thus, the belt and suspenders aid the user in maneuvering the guide pole by retaining the bushing adjacent the user's stomach so that the pole pivots about the bushing.

Figure 8:
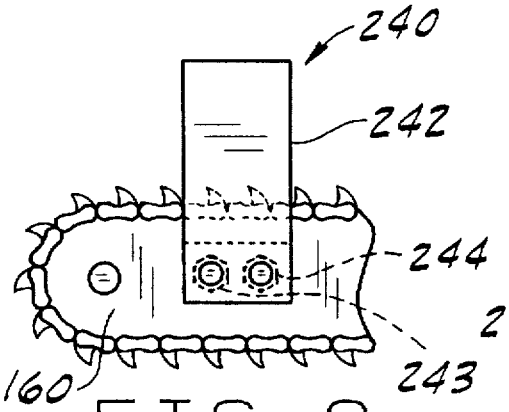
FIG. 8 is a partial side elevation view of a chain saw attachment used to cut from beneath a limb.
Figure 9:
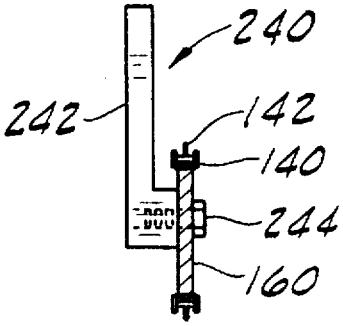
FIG. 9 is a partial rear elevation view of the chain saw attachment.

An attachment 240 as shown in FIGS. 8 and 9 may be used with the chain saw 26 to cut the under side of branches without causing "kick-back". Due to the configuration of a typical chain saw 26, the saw will violently jerk rearward away from a limb if the chain and cutter teeth contact the limb along the top of the guide bar 160. The anti-kick-back attachment 240 includes an offset plate 242 which is fastened to the guide bar 160 with fasteners 243, 244. The saw 26 is positioned so that the limb rests against the rearward edge of this plate 242 to prevent the saw from kicking rearward.

Figure 10:
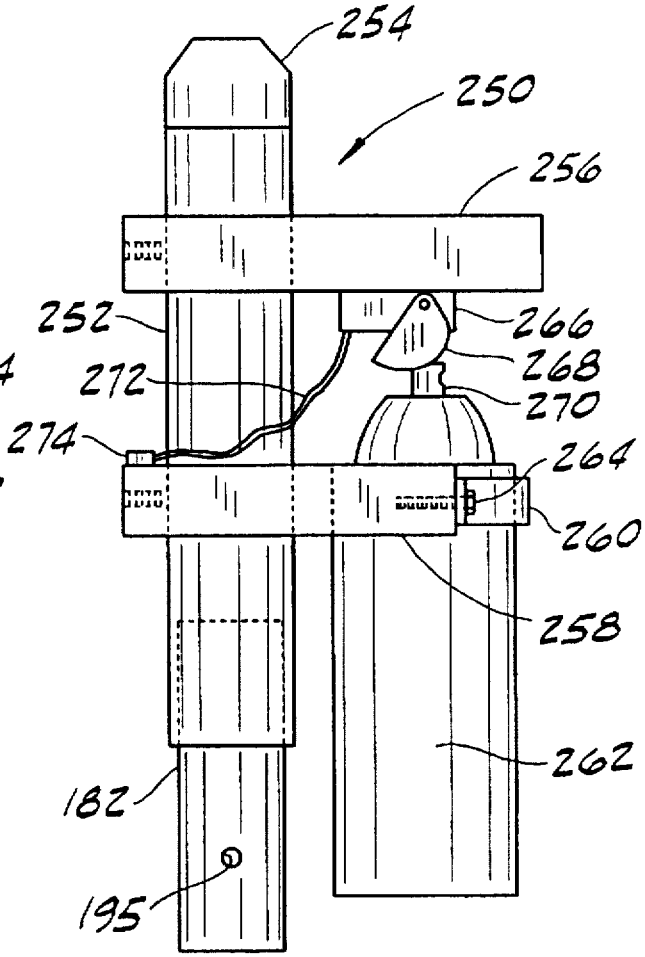
FIG. 10 is a side elevation view of an paint sprayer attachment used to paint previously cut surfaces.

A separate paint sprayer attachment 250 as shown in FIG. 10 may be used to paint the cut surfaces. The sprayer attachment 250 is attached to the upper tubing 186 with a coupler 182 identical to the couplers used to hold the sections of tubing together. The sprayer attachment 250 is comprised of a short length of tubing 252 having an end cap 254 and two brackets 256, 258 extending radially outward from the tubing as shown. The lower bracket 258 includes a clamp 260 for holding a typical aerosol paint dispenser 262 between the clamp and bracket 258. Fasteners 264 hold the clamp in place. Extending downward from the upper bracket 256 is a servomechanism 266 which drives a cam 268 to alternately press and release the valve 270 of the aerosol paint dispenser 262. Electrical leads 272 extend from the servomechanism 266 to a connector plug 274 so that electrical current from an auxiliary receiver and battery pack (not shown) may be used to actuate the servomechanism 266.

Figure 11:
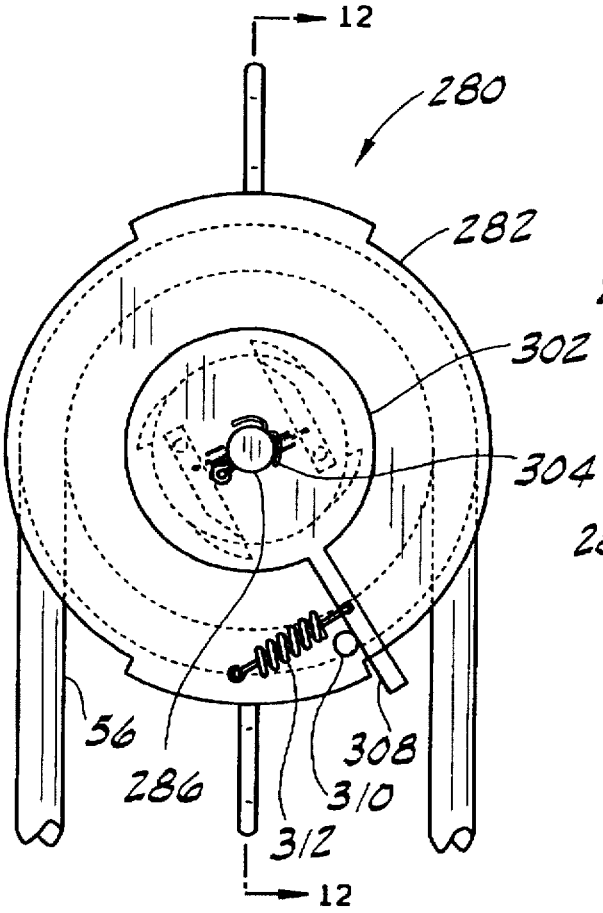
FIG. 11 is a side elevation view of an upper block having a locking mechanism.
Figure 12:
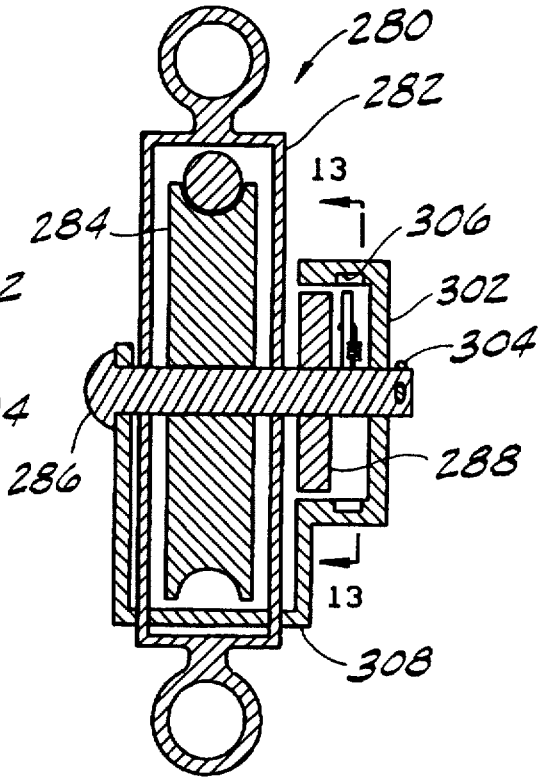
FIG. 12 is a cross-sectional view of the upper block of FIG. 11 is taken along the plane of line 12—12.
Figure 13:
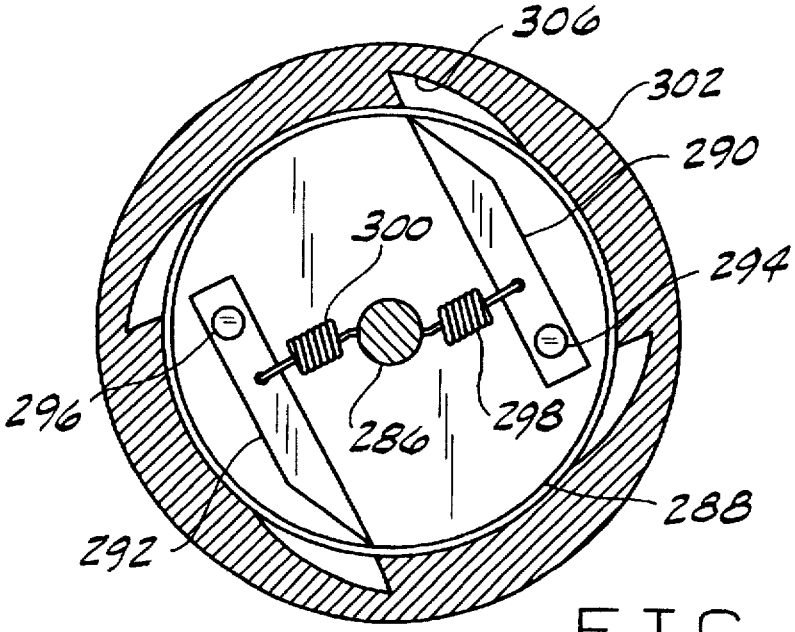
FIG. 13 is a cross-sectional view of the upper block taken along the plane of line 13—13 of FIG. 12.

As mentioned previously, the upper block of the tackle 24 may be modified to include a line brake mechanism for inhibiting the hoisted object from falling to the ground when the user inadvertently releases the line 56. Although other configurations are within the scope of the invention, the mechanism of the preferred embodiment is shown in FIGS. 11–13. The modified block 280 includes a housing 282, a pulley wheel 284 and an axle pin 286. The axle pin 286 is rigidly fixed to the pulley wheel 284 so that they turn together within the housing 282. Also rigidly fixed to the axle pin is a flywheel 288. As best seen in FIG. 13, the flywheel 288 includes two dogs 290, 292 which are pivotally connected to the flywheel by pins 294, 296. The dogs 290, 292 are biased toward the centerline of the flywheel by coil springs 298, 300. A clutch plate 302 is rotatively mounted to the axle pin 286 and held in place by a cotter pin 304 that is fastened through a hole (not shown) in the axle pin. The inner circumference of the clutch plate has notches 306 spaced circumferentially about it as shown in FIG. 13. A U-shaped arm 308 extends from the clutch plate 302, around the pulley wheel 284 and is rotatively attached to the axle pin 286 at the end opposite the cotter pin 304. The housing 282 includes a stop 310 which the U-shaped arm 308 rests against when the line brake is disengaged. A coil spring 312 extends between the U-shaped arm 308 and housing 282 to bias the arm against the stop 310. Thus configured, the pulley wheel 284 freely rotates with the line when the locking mechanism is in the disengaged position as shown. However, when the flywheel 288 rotates at a relatively high predetermined speed, such as when the chain saw is accelerating toward the ground because the user inadvertently releases the line, the dogs 290, 292 will move outward due to the centrifugal forces exceeding the biasing force of the coil springs 298, 300. As the dogs 290, 292 pivot outward, they engage the recesses 306 in the clutch plate 302 so that the clutch plate rotates with the flywheel and pulley wheel. Thus, the U-shaped arm 308 attached to the clutch plate rotates upward and pinches the line against housing 282 thereby preventing further descent of the chain saw. To disengage the brake, the user simply pulls the free end of the line 56 until the biasing force of the spring 312 returns the U-shaped arm 308 to its disengaged position adjacent the housing stop 310.

To use the saw system 20 of the present invention, the user assembles the desired number of sections of tubing 180 with couplers 182 and pins 183 and the upper and lower tubings 186, 188 are attached to form the guide pole 28. The connector 22 is attached to the upper tubing 186 by inserting the fitting 42 of the connector into the end of the upper tubing so that the eye 44 of the connector seats within the notch 192 of the tubing. The carabiner 60 of the tackle 24 is attached to the eye 198 of the upper tubing and the line 56 is drawn tight to axially retain the connector 22 within the upper tubing 186.

Once the guide pole and connector are assembled as described above, the user attaches the belt about his or her waist and inserts the plug 216 of the lower tubing into the bushing 230 of the belt. Next, the guide pole 28 is raised and the hook 40 of the connector 22 is hooked around a mounting point such as a branch which is generally above the location on the limb to be cut. The mounting point need not be directly above the cutting location as the line 56 is sufficiently flexible to permit the saw 26 to be vertically offset from the connector 22. Tension is maintained on the line 56 as the connector 22 is hooked to the mounting point to prevent the connector from separating from the guide pole 28. In the preferred method, the hook 40 is hooked about the mounting point from behind so that the opening faces the user to permit the connector 22 to be easily removed from the mounting point as will be explained in more detail below.

Once the connector 22 is attached to the mounting point, the tension in the line 56 is released and the pole 28 is lowered to the ground thereby pulling the lower pulley 58 downward with the pole while feeding the line 56 through the upper block 50. Once the pole 28 is lowered, the chain saw 26 may be started and attached to the guide pole 28 by fastening the elbow 94 to the guide pole 28 with the pin 84. Then, the carabiner 60 may be removed from the eye 198 on the pole and attached to the hoisting eye 92 on the chain saw mounting attachment 70. Using the mechanical advantage of the tackle 24, the user can hoist the chain saw to the selected cutting location by pulling the line 56 back through the upper block 50. Once the chain saw 26 is in position, the user activates the transmitter to send a radio signal on the second channel to unlock the second servomechanism 168 and permit the guard 162 to pivot relative to the guide bar 160 so that a cut can be made. Next, the user accelerates the engine by pulling the trigger on the transmitter 34 to send a radio signal on the first channel to the receiver 32 to actuate the first servomechanism 30 connected to the chain saw throttle. The line 56 is fed out to lower the chain saw onto the selected location until the cut is complete. If necessary, the guide pole 28 may be used to maneuver the chain saw as the cut is being made. Once the cut is complete, the transmitter 34 may be activated to send the appropriate radio signal to the receiver 32 to kill the chain saw engine. The chain saw may then be lowered from the tree by letting out the line 56.

Once the chain saw and pole are lowered to the ground, the user may disconnect the connector 22 from the tree by disconnecting the carabiner 60 and pulling the line 56 until the lower pulley 58 is tight against the upper block 50. Once the slack is taken out of line 56, the line is shaken up and down until the connector 22 falls out of the tree. Experience has shown that by placing the connector in the tree with the opening facing the user, very little effort is required to shake the connector out of the tree. However, the amount of effort required is sufficient to prevent the connector from being inadvertently dislodged from the tree.

If it is desired to paint the newly cut tree, the paint attachment 250 may be connected to the guide pole 28 using the pin 183. Then, the pole may be lifted into the tree until the sprayer attachment is adjacent the newly cut surface. Once the sprayer attachment is in the appropriate position, a transmitter may be activated to send a signal to the receiver to open the valve 270 on the paint dispenser 262 to spray paint onto the newly cut surface.

By using the method of the present invention, a tree may be trimmed quickly without the need for bucket trucks and without the need to climb the tree. Thus, significant expense and risk of injury may be avoided. Further, because there is no direct electrical connection between the top of the pole and the user, the opportunity for electrical shock is significantly reduced with the system of this invention.

While the present invention has been described by reference to a specific embodiment, it should be understood that modifications and variations of the invention may be constructed without departing from the scope of the invention defined in the following claims.

What is claimed is:

1. Apparatus for remotely cutting a selected tree branch comprising:

connector for releasably connecting the apparatus to a mounting point positioned generally above the selected tree branch;

a flexible line attached to the connector and extending generally down from the connector when the apparatus is connected to the mounting point by the connector;

a power saw having cutter teeth for cutting the selected tree branch attached to the line, the saw being suspended from the connector by the flexible line when the apparatus is connected to the mounting point by the connector; and a remotely operable control system operatively connected to the saw fox remotely activating the saw to cut the selected branch, wherein said controls system comprises a radio transmitter selectively operable to transmit a radio signal and a radio receiver in radio communication with the transmitter and operatively connected to the saw for activating the saw to cut the branch in response to receiving the radio signal from the transmitter.

2. Apparatus as set forth in claim 1 wherein:

the saw is selectively operable at a plurality of speeds;

the radio transmitter is selectively operable to change a signature of the radio signal transmitted; and the radio receiver activates the saw to operate at one of said plurality of speeds corresponding to the signature of the radio signal received.

3. Apparatus as set forth in claim 1 further comprising a guide pole extending from the saw for guiding the saw.

4. Apparatus as set forth in claim 3 wherein the guide pole is electrically insulated.

5. Apparatus as set forth in claim 3 wherein the guide pole is selectively attachable to and releasable from both the saw and the connector.

6. Apparatus as set forth in claim 3 wherein the saw is a powered chain saw having an elongate, planar guide bar mounted at an angle with respect to the guide pole.

7. Apparatus as set forth in claim 6 wherein the angle between the guide bar and the guide pole is between about 120°degrees and about 145°degrees.

8. Apparatus for remotely cutting a selected tree branch comprising:

a connector for releasably connecting the apparatus to a mounting point positioned generally above the selected tree branch;

a flexible line attached to the connector and extending generally down from the connector when the apparatus is connected to the mounting point by the connector;

a power saw having cutter teeth for cutting the selected tree branch attached to the line, the saw being suspended from the connector by the flexible line when the apparatus is connected to the mounting point by the connector;

a guard attached to the saw for covering the cutter teeth, the guard being moveable between a first position in which the guard inhibits contact with the cutter teeth and a second position in which the guard permits contact between the cutter teeth and the branch;

a remotely operable control system operatively connected to the saw for remotely activating the saw to cut the selected branch, wherein said control system comprises a radio transmitter selectively operable to transmit a radio signal and a radio receiver in radio communication with the transmitter and additionally operatively connected to the guard for selectively permitting and inhibiting the guard to move between the first and second positions.

9. Apparatus as set forth in claim 8 wherein:

said radio signal is a first radio signal and the radio transmitter is selectively operable to transmit said first radio signal on a first channel and a second radio signal on a second channel; and the radio receiver is operatively connected to the saw for activating the saw to cut the branch in response to receiving said second radio signal from the transmitter, the radio transmitter and receiver thereby forming at least a portion of said remotely operable control system.

10. Apparatus for remotely cutting a selected tree branch comprising:

a connector for releasably connecting the apparatus to a mounting point positioned generally above the selected tree branch;

a flexible line attached to the connector and extending generally down from the connector when the apparatus is connected to the mounting point by the connector;

a power saw having cutter teeth for cutting the selected tree branch attached to the line, the saw being suspended from the connector by the flexible line when the apparatus is connected to the mounting point by the connector;

a remotely operable control system operatively connected to the saw for remotely activating the saw to cut the selected branch;

a guide pole extending from the saw for guiding the saw; and a paint dispenser attachment connectable to the guide pole for painting a portion of the selected tree branch with a pressurized spray dispenser, the attachment including a remotely operable control for remotely activating the spray dispenser to paint the selected branch.

11. Apparatus for remotely cutting a selected tree branch comprising:

a power saw having a housing, an engine mounted in the housing and a plurality of cutter teeth driven by the engine for cutting the selected tree branch, the saw having an engaged condition in which the cutter teeth move and a non-engaged condition in which the cutter teeth are stationary;

a radio transmitter selectively operable to transmit a radio signal; and a radio receiver in radio communication with the transmitter and operatively connected to the saw for switching the saw between the engaged and non-engaged conditions in response to receiving the radio signal from the transmitter.

12. Apparatus as set forth in claim 11 wherein:

the saw is selectively operable to drive the cutter teeth at a plurality of speeds when in the engaged condition;

the radio transmitter is selectively operable to change a signature of the radio signal transmitted; and the radio receiver activates the saw to drive the cutter teeth at one of said plurality of speeds corresponding to the signature of the radio signal received.

13. Apparatus as set forth in claim 11 wherein said radio signal is a first radio signal, the radio transmitter is selectively operable to transmit a second radio signal, the apparatus further comprises a switch connected to the saw, the switch being operable to switch the saw between a running condition in which the saw engine is operable and a stopped condition in which the saw engine is inoperable, and the receiver is additionally operatively connected to the switch for selectively stopping the engine in response to receiving said second radio signal from the transmitter.

14. Apparatus as set forth in claim 11 further comprising a guard attached to the saw for covering the cutter teeth, the guard being moveable between a first position in which the guard inhibits contact with the cutter teeth and a second position in which the guard permits contact between the cutter teeth and the branch.

15. Apparatus as set forth in claim 14 wherein:

said radio signal is a first radio signal and the radio transmitter is selectively operable to transmit said first radio signal on a first channel and a second radio signal on a second channel; and the radio receiver is operatively connected to the guard for selectively permitting and inhibiting the guard to move between the first and second positions in response to receiving said second radio signal from the transmitter.

16. Apparatus as set forth in claim 11 further comprising a pole attached to the saw for guiding the saw.

17. Apparatus as set forth in claim 11 further comprising a flexible line attached to the saw for suspending the saw from a point positioned generally above the selected tree branch.

* * * * *